US006280403B1

(12) United States Patent
Lok

(10) Patent No.: US 6,280,403 B1
(45) Date of Patent: Aug. 28, 2001

(54) MASSAGE DEVICE

(75) Inventor: Lau Lok, Hong Kong (CN)

(73) Assignee: Nanma Manufacturing Company Limited, Hong Kong (CN)

( * ) Notice: Subject to any disclaimer, the term of this patent is extended or adjusted under 35 U.S.C. 154(b) by 0 days.

(21) Appl. No.: 09/346,044

(22) Filed: Jul. 7, 1999

(30) Foreign Application Priority Data

May 20, 1999 (GB) ..... 9911806

(51) Int. Cl.[7] ..... A61H 1/00

(52) U.S. Cl. ..... 601/70; 601/46; 601/67; 601/69

(58) Field of Search ..... 601/46, 56, 57, 601/67–72, 76–83, 84, 89, 93, 97, 101, 15; 607/112–114; 446/267, 3

(56) References Cited

U.S. PATENT DOCUMENTS 3,382,606 * 5/1968 Johnson ..... 46/91
3,504,665 * 4/1970 Bakunin et al. ..... 601/71
3,585,990 * 6/1971 Blachly ..... 601/72
4,192,035 * 3/1980 Kuris ..... 15/22.1
5,009,222 * 4/1991 Her ..... 601/71
5,140,976 * 8/1992 Cheng ..... 601/70
5,283,921 * 2/1994 Ng ..... 15/22.1
5,554,102 * 9/1996 Chiou ..... 601/72
5,688,063 * 11/1997 Yu et al. ..... 601/72
6,037,078 * 3/2000 Siu-Man ..... 429/96

* cited by examiner

*Primary Examiner*—Justine R. Yu
(74) *Attorney, Agent, or Firm*—Young & Thompson

(57) ABSTRACT

A massage device includes an inner housing containing a vibrational element for generating vibrations to be transmitted to the inner housing and an outer housing to be disposed around the inner housing and so as to define a closed sealed chamber therebetween. The outer housing is releasably sealingly mounted relative to the inner housing so as to be removable therefrom for receipt of a fluid substance therein. The outer housing can advantageously be detached in a quick and ready manner and which then presents an aperture through which the appropriate fluid can be evacuated from, and subsequently replaced, in a quick, clean and easy fashion.

10 Claims, 3 Drawing Sheets

MASSAGE DEVICE

FIELD OF THE INVENTION

The present invention relates to a massage device and in particular, but not exclusively, a massage device that can be used internally within the human body.

BACKGROUND OF THE INVENTION

A wide variety of massaging devices are currently known for application to the exterior and/or interior of the human body as required. However, the variety of sensations achieved by such known devices can be seen to be disadvantageously limited in that the device merely presents a vibrating mechanism for transferring vibrations via an outer surface of the device to that part of the human body which is contacted by the device. While the speed and magnitude of the vibrations generated can be adjusted so as to change the sensory characteristics of the massaging device, this generally amounts to the sole operational characteristic of known devices that can be selectively varied.

While it has also been known to employ water-filled massaging devices such devices are nevertheless disadvantageously limited in the manner in which the temperature of the water found within the massaging device can be selectively varied.

SUMMARY OF THE INVENTION

The present invention therefore seeks to provide for a massage device having advantages over known such devices.

According to the present invention there is provided a massage device comprising an inner housing containing a vibrational element for generating vibrations to be transmitted to the inner housing, an outer housing to be disposed around the inner housing and so as to define a closed and sealed chamber therebetween, the outer housing being releasably sealingly mounted relative to the inner housing so as to be removable therefrom for receipt of a fluid substance therein.

The invention is therefore advantageous in that it provides a detachable outer housing into which any appropriate fluid at any required temperature can be introduced such that upon reattachment of the housing so as to reseal the chamber, the chamber then contains the appropriate fluid at the appropriate temperature so as to potentially heighten the sensory enjoyment and satisfaction achieved through use of the massager.

Insofar as the outer housing is arranged to be disposed around the inner housing, it necessarily presents a relatively large aperture through which the inner housing is inserted and, likewise, through which the required fluid can readily be introduced to, and removed from, the outer housing. This allows for effective ready filling and evacuation of the chamber so that the fluid can be quite easily replenished at any particular stage during the use of the massage device. In particular, the replenishment can be achieved once perhaps the fluid is no longer at the temperature required by the user and can be readily replaced by fluid at the same, or indeed quite a different, temperature. Thus, the relatively large aperture present in the outer housing that allows for mounting of the inner housing relative to the outer housing, and likewise provides the aperture through which the aforesaid fluid is introduced to, or evacuated from, the chamber to be defined by the outer housing, can advantageously provide the means whereby the temperature for the massage device can be altered by a relatively large degree relatively quickly and without causing any unsatisfactory delay in use of the massage device.

Preferably, the outer housing can be arranged to be releasably sealed by means of a screw thread arrangement.

In particular, the inner housing may be associated with an upstanding cylindrical threaded flange for receipt of a threaded portion of the outer housing therein.

Advantageoulsy, the device can include a resilient sealing member arranged to be sandwiched between a portion of the outer housing and a portion of the upstanding cylindrical threaded flange.

The resilient sealing member can comprise a resilient annular member arranged to be located in the regions of the threaded portions of the outer housing member and the upstanding cylindrical threaded flange.

BRIEF DESCRIPTION OF THE DRAWING

The present invention is described further hereinafter, by way of example only, with reference to the accompanying drawings in which.

DETAILED DESCRIPTION OF THE PREFERRED EMBODIMENTS

Figure 1:
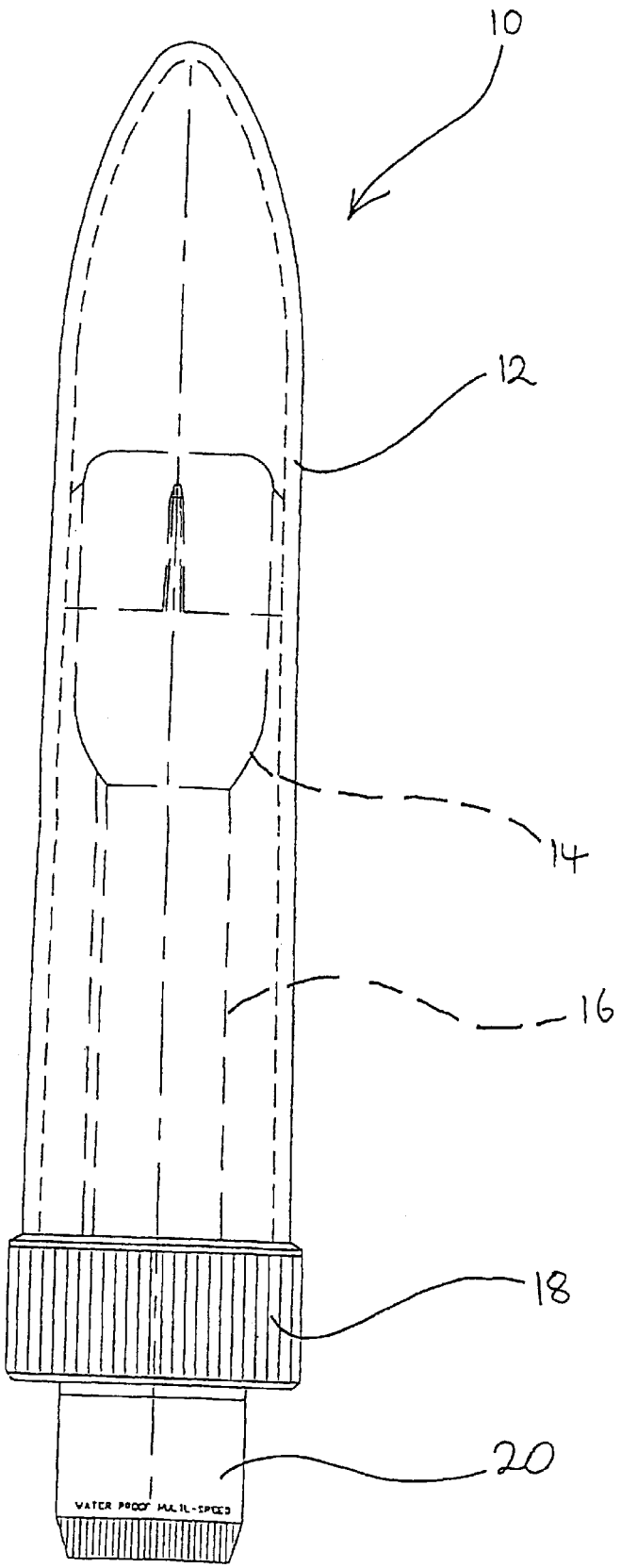
FIG. 1 is a side elevational view of a massager embodying the present invention.

Turning first to FIG. 1, the relative shape and dimensions of a massager device 10 embodying the present invention can be appreciated as comprising an elongate generally cylindrical outer housing 12 within which is located a vibration generator 14 powered by means of an electrical source housed within a cylindrical battery housing 16. The base of the massager 10 is formed with an upstanding annular collar 18 from one side of which extends a control cap arrangement 20 providing a rotary control for activating/deactivating the vibration generator. The upstanding annular collar 18 is likewise arranged to receive a base region of the outer housing 12 in a sealed manner as described further herein.

Figure 2:
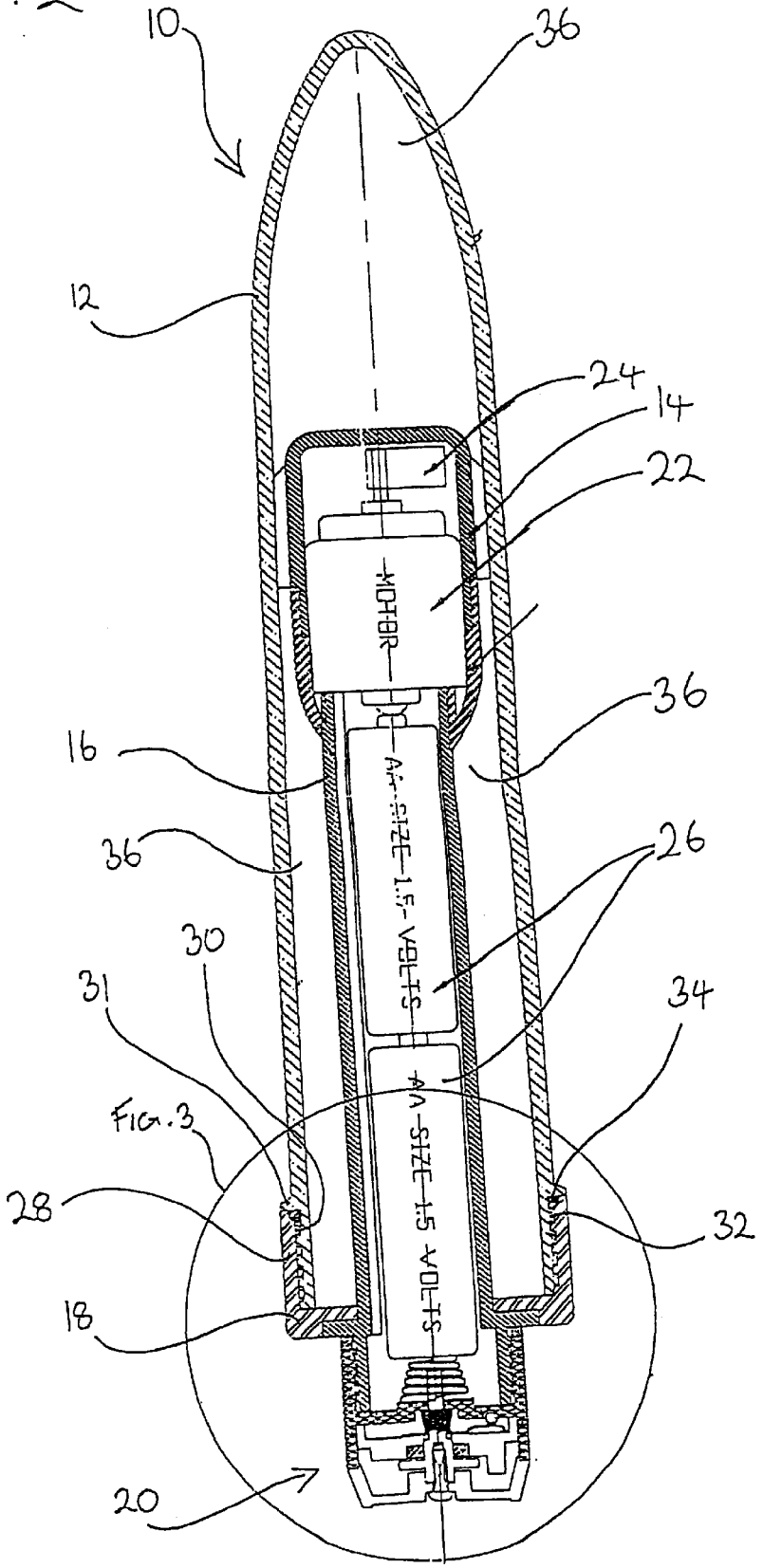
FIG. 2 is a longitudinal sectional view of the massager of FIG. 1.

Turning now to FIG. 2, this illustrates a longitudinal sectional view of the massager 10 of FIG. 1 and it can here be seen that the vibration generator 14 includes a motor 22 having a rotatable shaft extending therefrom upon which is mounted an off-centre mass 24. It is the fast rotation of the off-centre mass 24 via the motor 22 powered by the electrical source in the form of batteries 26 located within the battery housing 16 that serves to provide for the vibrations that are eventually transmitted from the massager device 10 to the user.

FIG. 2 also illustrates the manner of connection of the base region of the outer housing 12 to the upstanding collar 18. The upstanding collar 18 presents a cylindrical wall 28 the inner surface of which is provided with a thread 30. The aforementioned base region of the outer housing 12 presents an annular lip 31 below which extends a portion of the cylindrical wall of the housing 12 having an exterior surface that presents a threaded formation 32 arranged to cooperate with the thread 30 of the cylindrical wall 28 of the upstanding collar 18. Provided beneath the lip 31 of the outer wall of the base portion of the outer housing 12 is an annular resilient sealing member 34 such as an O-ring and which is to form a seal between the lip 31 and the threaded surfaces of the cylindrical wall 28 of the upstanding collar 18 and the threaded wall 32 of the outer housing 12 once the outer housing 12 is screwed into firm engagement with the upstanding collar 18.

As will be appreciated, the combined walls of the vibration generator 14 and battery housing 16 define an inner housing which, in combination with the outer housing 12 serve to define a closed sealed chamber 36. The chamber 36 remains closed and sealed by action in particular of the threaded engagement of the outer housing 12 to the upstanding collar 18 and by deployment of the O-ring 34 as illustrated.

Figure 3:
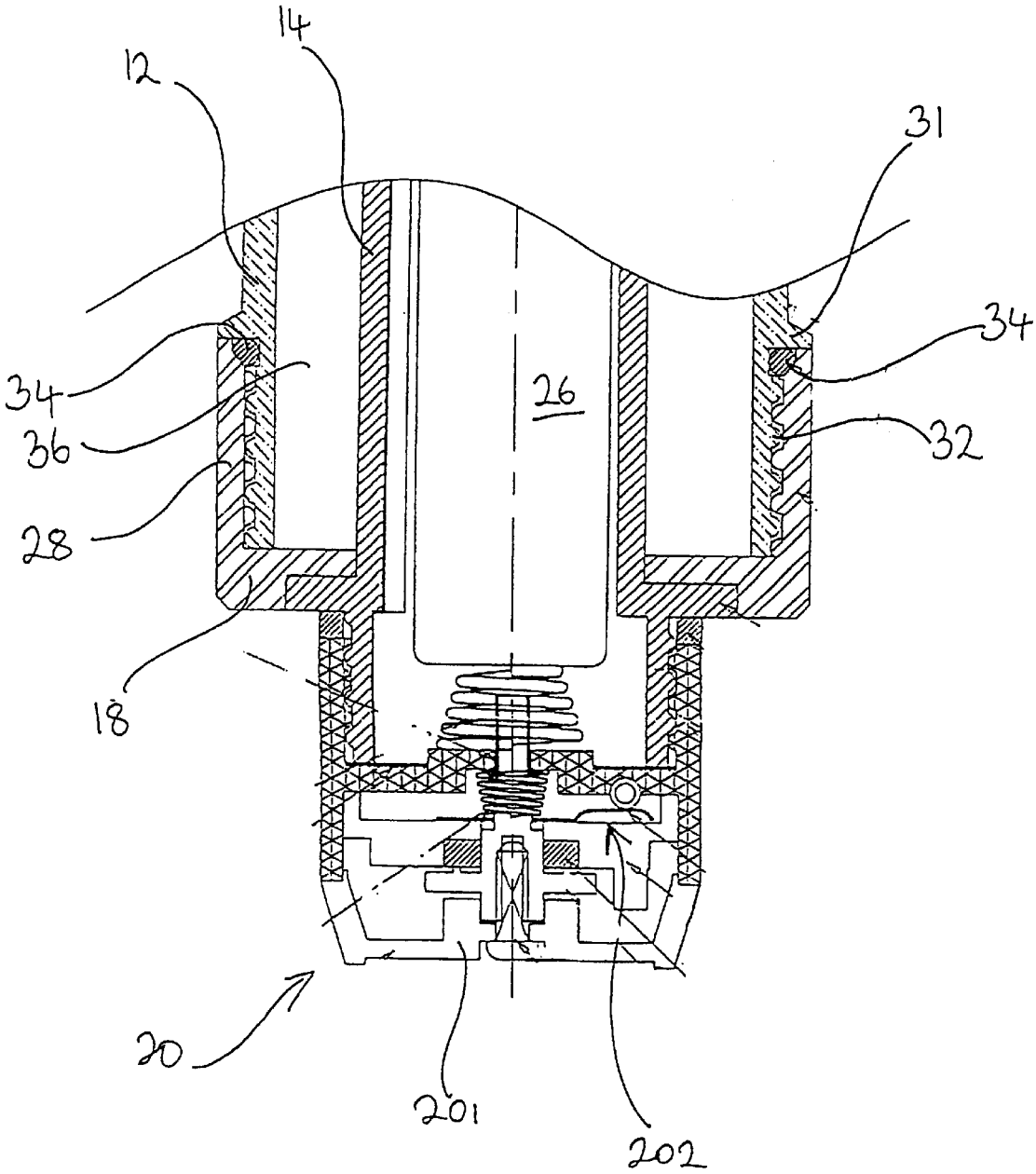
FIG. 3 is an enlarged sectional part view of the base region of the massager of FIGS. 1 and 2.

FIG. 3 shows in greater detail the sealing arrangement achieved by means of the O-ring 34 which, in this particular embodiment, can be seen to be housed within an annular recess defined between the lip 31 on the outer surface of the base region of the outer housing 12 and a bevelled portion of the upper region of the cylindrical wall 28 of the upstanding collar 18.

The control cap 20 serves to provide a means for varying the speed of rotation of the centre mass 24 and comprises a disc-like rotatable control member 201 arranged to move a contact plate arrangement 202 which serves to control the electrical current delivered from the batteries 26 to the motor 22, and thereby the speed of rotation of the off-centre mass 24. Such a control cap arrangement is described in published UK patent application GB 2,322,469 A and has the required contact plates, compression spring, rotatable potentiometer disk and rubber washer member located in contact with the contact plate and between the spring and rotatable disk. This control cap exhibits particularly advantageous features serving to achieve water proofing for a control cap arrangement 20 which can advantageously be incorporated into the present invention in view of the intended use of the invention in combination with a fluid such as water.

It will be appreciated that, as and when a particular fluid is to be introduced in the massager device 10, the outer housing 12 is rotated relative to the upstanding collar 18 so as to be screwed out of engagement therewith and so as the outer housing is fully detached from the remainder of the massaging device 10. The detached outer housing 12 can then have an appropriate fluid, for example water, which is at any required predetermined temperature poured therein such that, upon the introduction of the remainder of the massager device 10 (i.e. the portions defined by the vibration generator 14, battery housing 16, the upstanding collar and control cap arrangement 20), the sealed chamber 36 can then effectively be re-established but with the fluid at the appropriate temperature provided therein. The massager device 10 can then be applied as required by the user in which, in addition to the sensations achieved by activation of the motor 22 with its off-centre mass 24 can, in addition, provide an appropriately pleasing or stimulating temperature sensation for the user.

Once the temperature presented by the massager device 10 has changed to a value out of a range acceptable for, or desired by, the user, the outer housing 12 can readily be unscrewed from the upstanding collar 18, the water present then discarded and replaced by water at an appropriate, i.e. the same or perhaps vastly different, temperature as required.

It will be appreciated that, since the outer housing 12 can readily employ a common aperture for the insertion of the remainder 14, 16 of the massager device 10 therein and also for the introduction of the fluid therein, the required fluid can be quite readily introduced into the chamber defined by the outer housing 12 in a quick and ready manner which prevents any undesirable delays arising when changing the water and therefore which also serves to reduce, and in particular seek to prevent, any unnecessary spillages.

It should of course be appreciated that the invention is not restricted to the details of the foregoing embodiments. For example, a massager device of any particular shape and configuration can be provided and any appropriate means of sealing engagement of the outer housing member relative to what is effectively an inner housing member, i.e. the walls of the vibration generator 14 and the battery housing 16 of the illustrated embodiment, can be provided as required.

What is claimed is:

1. A massager device comprising:

a liquid-tight inner housing;

a vibrational element within said inner housing for generating vibrations to be transmitted to said inner housing; and a liquid-tight outer housing to be disposed around said inner housing and so as to define a closed sealed chamber therebetween, said outer housing being releasably sealingly mounted relative to said inner housing so as to be removable therefrom for receipt of a fluid substance to completely fill said chamber with liquid within said outer housing.

2. The massager device as claimed in claim 1, wherein said upstanding cylindrical threaded flange is provided integral with said inner housing.

3. The massager device as claimed in claim 1, wherein said upstanding cylindrical threaded flange is fastened to said inner housing.

4. The massager device as claimed in claim 1, wherein an inner wall of said upstanding cylindrical flange is threaded.

5. The massager device as claimed in claim 1, further comprising a resilient sealing member arranged to be sandwiched between said threaded portion of said outer housing and a portion of said upstanding cylindrical threaded flange.

6. The massager device as claimed in claim 5, wherein said resilient sealing member comprises a resilient annular member arranged to be located in the regions of the threaded portions of said outer housing member and said upstanding cylindrical threaded flange.

7. The massage device as defined in claim 1, wherein said inner housing and said outer housing are substantially cylindrical.

8. A massager device as claimed in claim 7, wherein said inner housing and said outer housing extend substantially co-axially.

9. A massager device comprising:

an inner housing;

a vibrational element within said inner housing for generating vibrations to be transmitted to said inner housing;

an upstanding cylindrical threaded flange integral with said inner housing; and an outer housing having a threaded portion to be disposed around said inner housing and so as to define a closed sealed chamber therebetween, said outer housing being releasably sealingly mounted relative to said inner housing by said threaded flange and said threaded portion of said outer housing so as to be removable therefrom for receipt of a fluid substance to completely fill said chamber within said outer housing.

10. A massager device comprising:

an inner housing;

a vibrational element within said inner housing for generating vibrations to be transmitted to said inner housing;

an upstanding cylindrical threaded flange fastened to said inner housing; and an outer housing having a threaded portion to be disposed around said inner housing and so as to define a closed sealed chamber therebetween, said outer housing being releasably sealingly mounted relative to said inner housing by said threaded flange and said threaded portion of said outer housing so as to be removable therefrom for receipt of a fluid substance to completely fill said chamber within said outer housing.

* * * * *